US005374207A

United States Patent [19]

Lindberg

[11] Patent Number: 5,374,207

[45] Date of Patent: Dec. 20, 1994

[54] DEVICE FOR SETTING THE PROPULSION MEANS OF WATERCRAFT IN VARIOUS ANGULAR POSITIONS

[75] Inventor: Gunnar Lindberg, LÅngesandsvägen, Sweden

[73] Assignee: Motala Verkstad AB, Motala, Sweden

[21] Appl. No.: 917,079

[22] PCT Filed: Dec. 3, 1991

[86] PCT No.: PCT/SE91/00816

§ 371 Date: Aug. 3, 1992

§ 102(e) Date: Aug. 3, 1992

[87] PCT Pub. No.: WO92/09476

PCT Pub. Date: Jun. 11, 1992

[30] Foreign Application Priority Data

Dec. 3, 1990 [SE] Sweden ..... 9003834-0

[51] Int. Cl.[5] ..... B63H 5/12

[52] U.S. Cl. ..... 440/57; 440/83

[58] Field of Search ..... 440/53, 54, 55, 56, 440/57, 58, 59, 75, 83; 60/232; 239/265.19, 265.35

[56] References Cited

U.S. PATENT DOCUMENTS

| | | | |
|---|---|---|---|
| 3,429,509 | 2/1969 | Markowski | 60/232 |
| 3,687,374 | 8/1972 | Nash | 60/232 |
| 4,037,558 | 7/1977 | Nossiter | 440/57 |
| 4,565,532 | 1/1986 | Conner | 440/57 |
| 4,728,308 | 3/1988 | Weismann | 440/57 |

FOREIGN PATENT DOCUMENTS 462589 7/1990 Sweden .

*Primary Examiner*—Stephen P. Avila
*Attorney, Agent, or Firm*—Dvorak and Traub

[57] ABSTRACT

A device for setting the propulsion means of a watercraft in an arbitrary angular position within the perimeters of an imaginary conical configuration with one end of the propulsion means attached to an apex of the cone. The device comprises a first sleeve which is arranged for rotational movement about an axis which intersects the apex of the cone. The sleeve is formed with an angular portion. A second sleeve is arranged for rotating movement about the angular portion. A propulsion shaft extends through the sleeve, from the apex of the cone and exteriorly of the sleeve in a direction at an angle to the rotational axis of the sleeve, the axis likewise intersecting the apex of the cone.

7 Claims, 9 Drawing Sheets

DEVICE FOR SETTING THE PROPULSION MEANS OF WATERCRAFT IN VARIOUS ANGULAR POSITIONS

The subject invention concerns a device in motorboats or large motor-propelled ships for setting the [propulsions] propulsion means in an arbitrary angular position within the perimeters of an imaginary conical configuration with one end of the propulsion means attached to the apex of the cone.

Various types of devices are known to bring about yawing of a motor-boat or a large motor-propelled ship. The most common arrangement is to use a fixedly orientated propeller and a rudder by means of which it is possible to make the boat yaw towards the port or starboard side.

In the case of boats equipped with outboard motors the entire motor unit including the propeller is made to turn in one direction or the other, thus forcing the boat to yaw towards the port or starboard side.

It is also known to use trim tabs which are provided at the boat stern and which trim tabs may be set in various tilting positions in relation to a horizontal plane in order to bring the boat to assume various tilting positions relatively to its [main] course of travel.

The subject invention provides a device by means of which it has become possible, [without] by direct actuation of the watercraft propulsion means and thus without the aid of any accessory means, to make the boat yaw in the port or starboard direction, or to affect its position of inclination, for instance to ensure that the boat "planes". The characteristic features of this device appear from the appended claims.

The invention will be described in closer detail in the following with reference to the accompanying drawings, wherein FIG. 1 illustrates one embodiment of the device in a perspective and longitudinal sectional view, FIGS. 2 and 3 [illustrates] illustrate, in a longitudinal sectional view, the same embodiment as in FIG. 1 but in two different positions of adjustment, FIG. 4 is a view of the device, partly in section, of a second embodiment, FIG. 5 illustrates, partly in section, a third embodiment of the device, FIGS. 6–19 show a number of vector diagrams designed to illustrate various angle positions of the device, and FIGS. 20 –27 show various embodiments of propulsions mechanisms for boats of prior-art constructions, each equipped respectively with a conventional device and with the device in accordance with the invention as applied to the propulsion unit.

The embodiment of the device in accordance with FIG. 1 includes a shell sleeve 1 which is assumed to be securely anchored to the boat hull. The device comprises a first sleeve 2, arranged for turning movements about an axis a which is coaxial with the output drive shaft 3 from the boat drive unit. The sleeve 2 is formed with a row of teeth 4 extending on the internal face of the sleeve 2 in the transverse direction thereof and engaging with a pinion 5 which is attached to a rotating rod 6 or rotating cable. With the aid of the rotating rod 6 the sleeve 2 may be rotated in either direction about its centre axis a. The sleeve 2 is formed with a portion 7 extending at an angle to the rotational axis a of the sleeve.

The device also comprises a second sleve 8. A shaft 10 for the boat propulsion means, assumed to be propeller, extends through and beyond said sleeve 8 from an articulation joint 9. Outside the sleeve 8, the drive shaft 10 extends in a direction which is at an angle to the rotational axis b of the sleeve 8. A gear rim 11 is formed at the inner marginal portion of the sleeve 8.

The embodiment of the invention disclosed in FIGS. 1–3 also comprises a third sleeve 12. The latter is arranged for turning movements coaxially with the first sleeve 2 and it is also formed with a gear rim 13 at one of its marginal portions, said rim partly engaging the gear rim 11 of the second sleeve 8. Like the first sleeve 2, the third sleeve 12 is formed with an internal row of teeth 14 extending in the transverse direction of the sleeve 12. A pinion 15 in engagement with said row of teeth 14 is attached to a rotating rod 16 or rotating cable. The third sleeve 12 is arranged, when turned in either direction by means of the rotational rod 16, to make the second sleeve 8 rotate in the same direction. The propulsion means shaft 10 will then be forced to move so as to describe a conically shaped body of revolution k.

FIGS. 2 and 3 may be assumed to show the device in a horizontal longitudinal sectional view, i.e. the device is seen from above. FIG. 2 then illustrates the setting position of the device ensuring maximum yawing of the boat in the port direction whereas FIG. 3 illustrates a setting position in which the boat travels straight ahead. By turning the sleeves 2 and 8 relatively to one another, it thus becomes possible to set the drive shaft 10 in any arbitrary angle position within the perimeters of the imagined cone k.

FIG. 4 illustrates an embodiment according to which the device is enclosed in a cover 17. The third sleeve 12 is eliminated in this embodiment. Instead, the first sleeve 2, as also the second sleeve 8, are provided with externally extending, transverse rows of teeth 18 and 19, respectively. The row of teeth 18 of sleeve 2 engages a worm gear 20 which is arranged to turn transversely relatively to the rotational axis of the sleeve 2, and correspondingly, a worm gear 21 engages the row of teeth 19 of the sleeve 9. By turning a rotating rod or cable, not shown, associated with the respective worm gear 20, 21 relative movement of the sleeves 2 and 8 is achieved, resulting in adjustment of the position of the drive shaft 10 in the same manner as in the case of the embodiment according to FIG. 1. A corresponding rotating movement of the sleeves 2 and 8 is achieved also if the worm gears 20 and 21 are replaced by racks that are displaceable in their longitudinal direction by means of traction/push rods or by means of cables arranged for movement backwards and forwards within flexible covers.

FIG. 5 shows a third embodiment according to which a propeller 22 is mounted on the drive shaft 10. In this embodiment, the sleeves 2 and 8 have a different appearance but principally an identical function compared with the previous embodiments for which reason the reference numbers have been retained. Like in the embodiment according to FIGS. 1–3 the relative rotation of the sleeves 2 and 8 is effected by means of rotating rods 23 and 24, respectively, which rods, via their respective pinion 25 and 26, engage interior rows of teeth 27 and 28, respectively. The essential difference from the two previous embodiments is the insertion, between the output shaft 3 of the drive motor and the drive shaft 10 of the propeller 22, of a universal driving shaft, the latter extending at an angle to the output shaft 3 as well as to the propeller shaft 10. This embodiment is intended to be used primarily in large motor-propelled ships where the stress on the drive unit largely exceeds that found in smaller ships, and where the load on one single joint, such as the articulated joint 9 according to the embodiment of FIGS. 1–3, could be unduly high.

One characteristic feature that is common to all three embodiments of FIGS. 1–5 is that all rotating shafts, i.e. the rotational shafts a and b of respectively the drive shaft 3 and the sleeves 2 and 8, intersect in one point in the joint 9. The advantage of these embodiments is that—when the drive transmission is not exceedingly high—rotational movement as well as drive to the propeller are transferred in a simple manner via one single articulated joint 9. In turn, this means that axial forces that are exerted on the propeller shaft 10 do not cause the occurrence of torque on the sleeves 2 and 8. In this way, possibilities are created for simple and convenient steering and setting of the device in various angle positions.

For clearer understanding of the function of the invention, it will be described in closer detail in the following with reference to the vector diagrams of FIGS. 6–19. Simultaneously, reference is also made to FIG. 2, in which figure $\alpha$ denotes the angle formed between the rotational axis a of the first sleeve 2 and the rotational axis b of the second sleeve 8, and $\beta$ denotes the angle between the rotational axis b of the second sleeve and the propeller drive shaft 10. In the vector diagrams, the length of a vector represents the corresponding angle, for instance angle $\alpha$ of sleeve 2 whereas the inclination of the vector is a direct representation of the "angular position of rotation" of the corresponding sleeve. The vector diagrams are a system of coordinates according to which the axes are graded in angular magnitudes. Origo represents "course straight ahead" and no lift either upwards or downwards of the boat hull.

In FIG. 6, the vector "H1" occupies an arbitrary position in the diagram. The vector is shown as "$\alpha$o long" and is turned outwards by an angle $\phi$ from the plumb-line. A propeller on a shaft set at this altitude angle and direction would cause the boat to yaw in the starboard direction in combination with providing some lift of the stern of the boat (trimming). As illustrated by the broken line in FIG. 6, the vector H1 may "be turned over a complete revolution", i.e. the angle $\phi$ could assume any value.

As shown in FIG. 2, there is another angle at one's disposal, viz. angle $\beta$. Since the action of sleeve 8 in all positions takes place at an angle to sleeve 2 it is necessary, as regards angle $\beta$, to start from the apex of vector H1 to completion of the diagram.

This is illustrated in FIG. 7 in which a second vector H2 has been given the same length as vector H1, for instance $\alpha=\beta=15°$. The maximum angle of deflection 30° is manifested by the inclination of both vectors H1 and H2 in the same direction, i.e. $\phi=\Psi$. the diagram also shows that in this set position, the boat leeway is approx. 25° to the right, in addition to which the boat stern is lifted rather heavily. Obviously, this setting position is not a realistic one and is shown herein only to illustrate how the diagram is to be interpreted.

If one wishes to give the boat a rudder deflection of for instance 25° to the right but without simultaneous lifting of the stern, the angular setting according to FIG. 8 is adopted.

Figure 1:
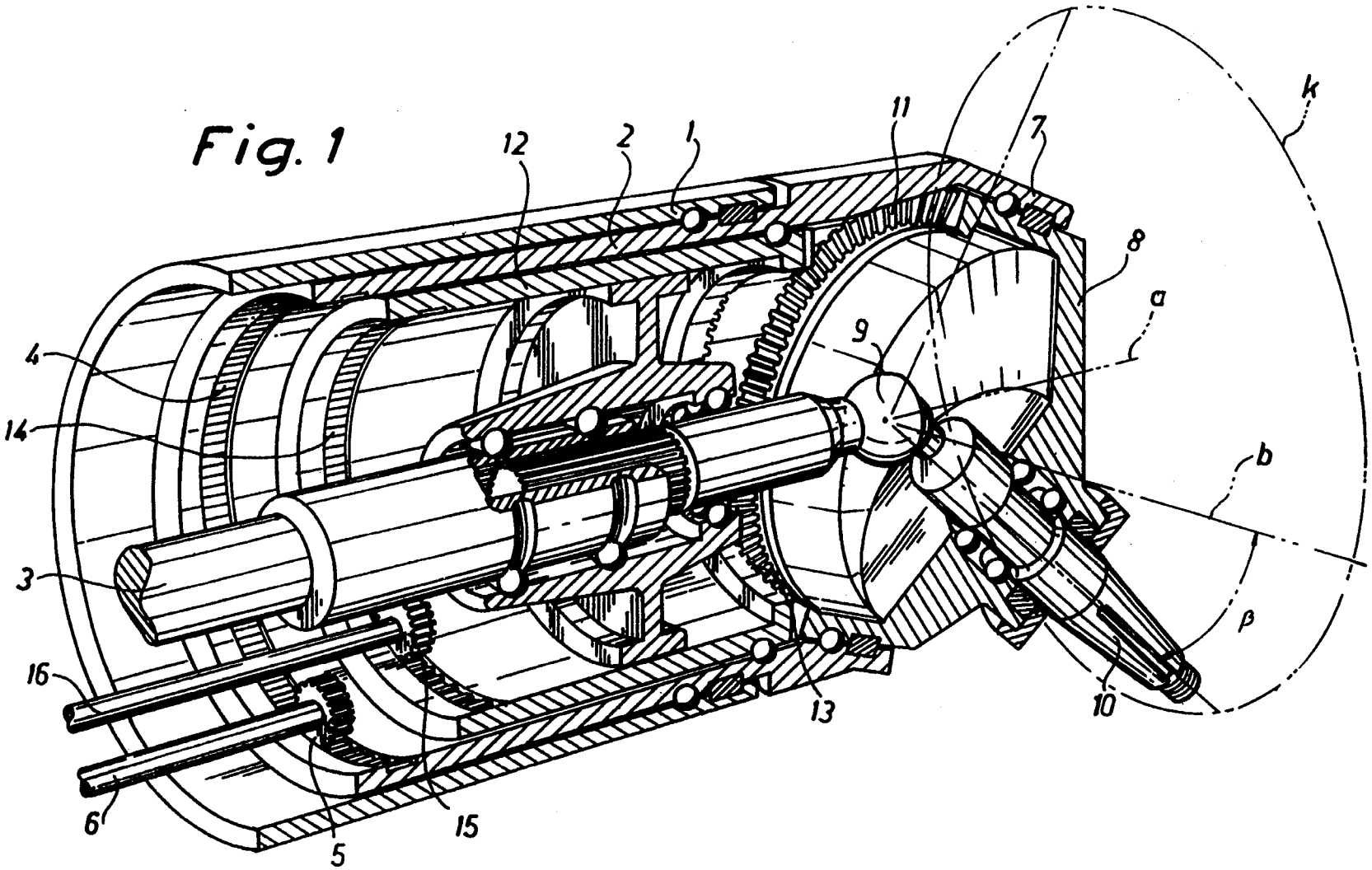
Figure 3:
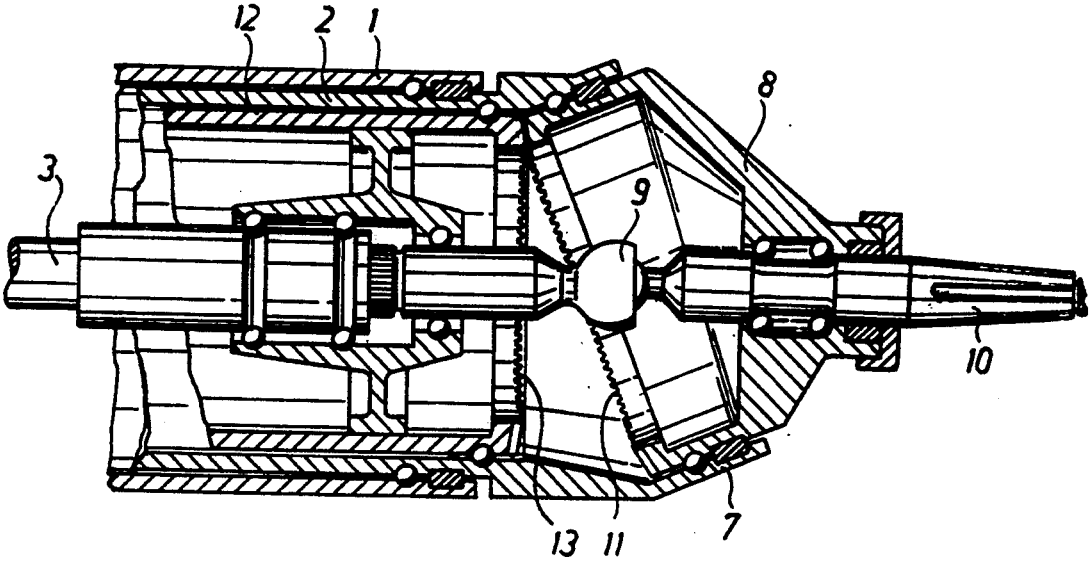
Figure 2:
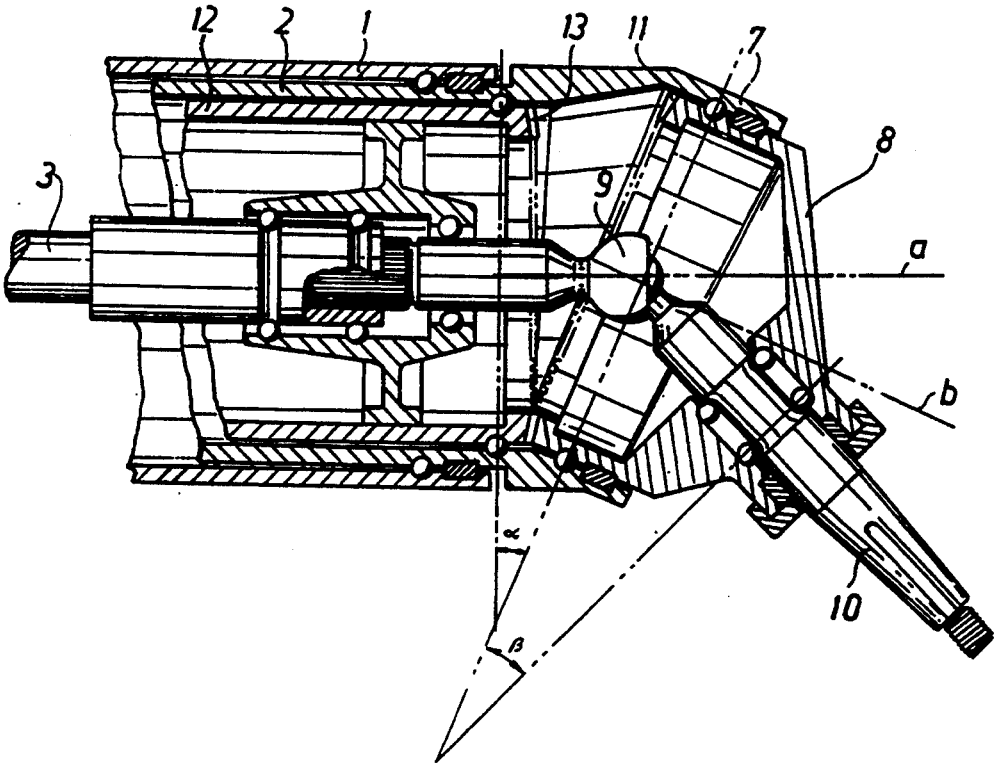
Figure 5:
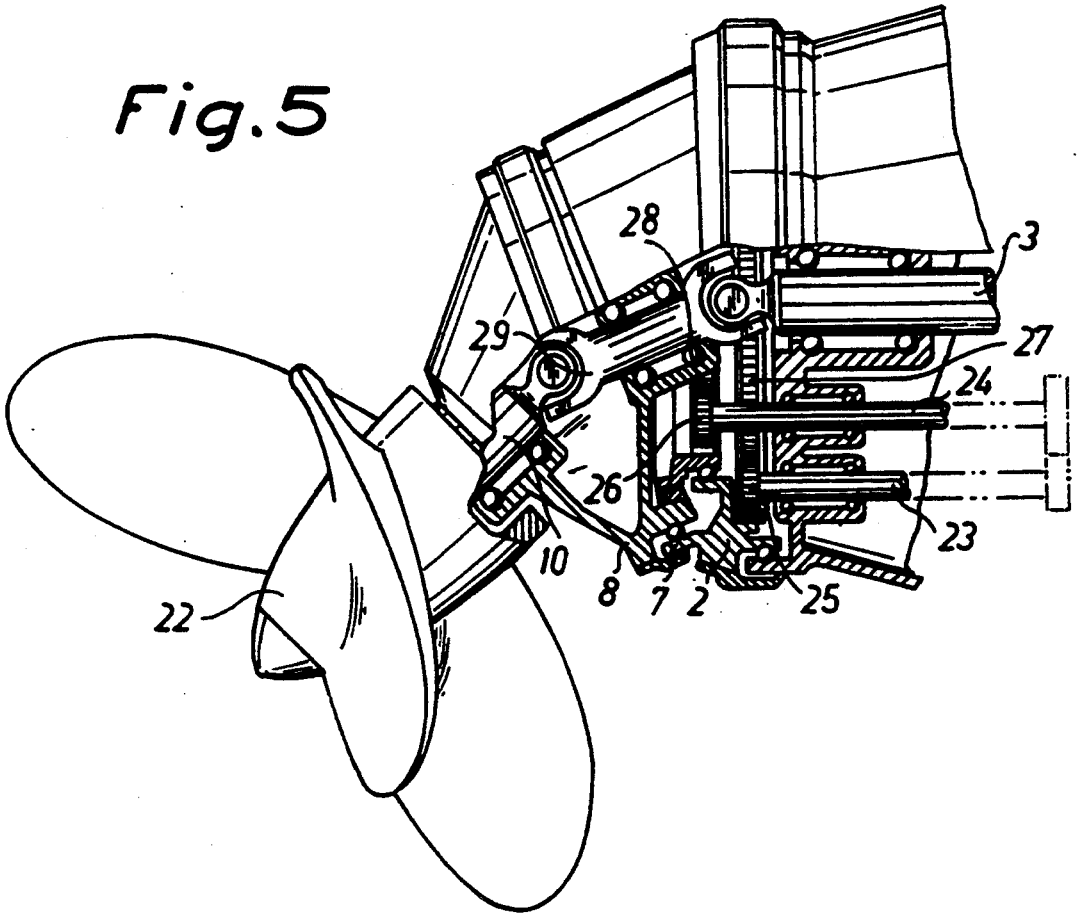
Figure 4:
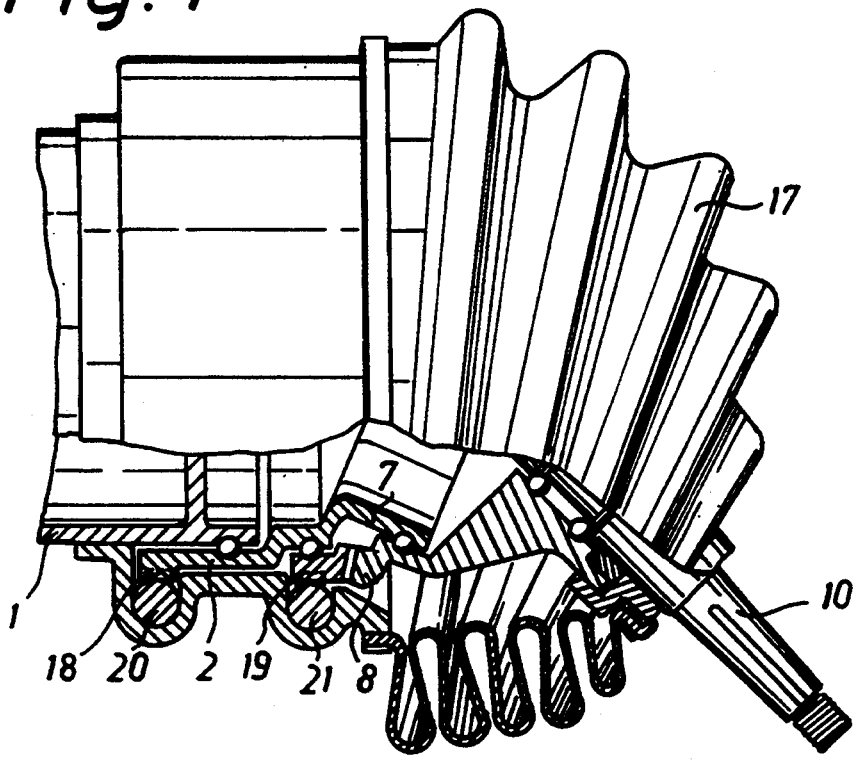
Figure 6:
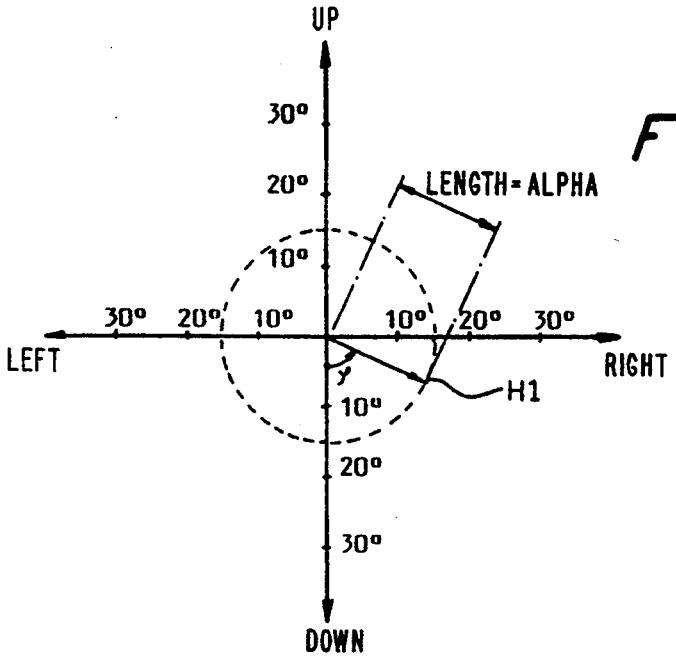
Figure 7:
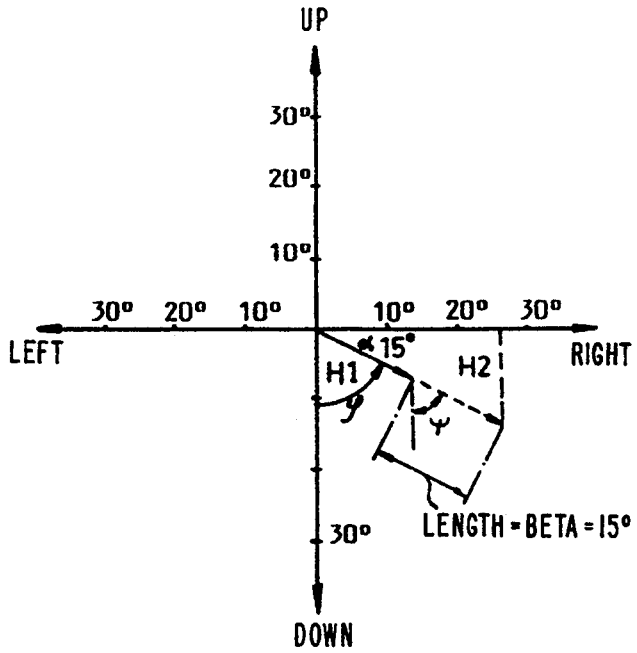
Figure 8:
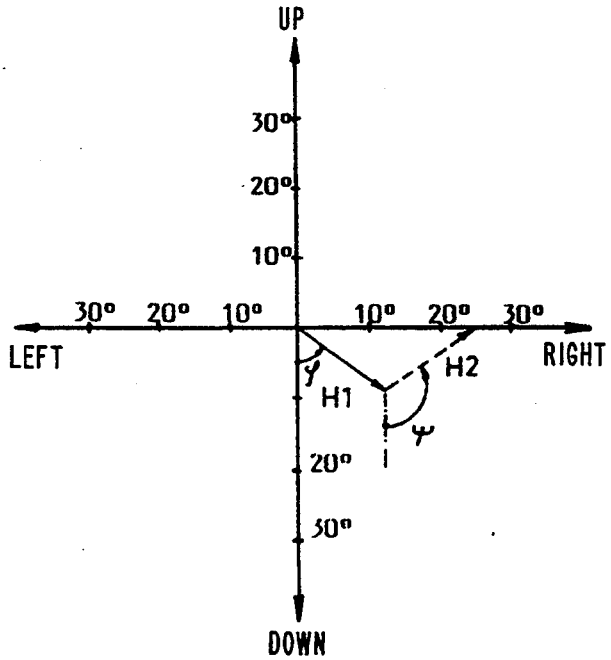
Figure 9:
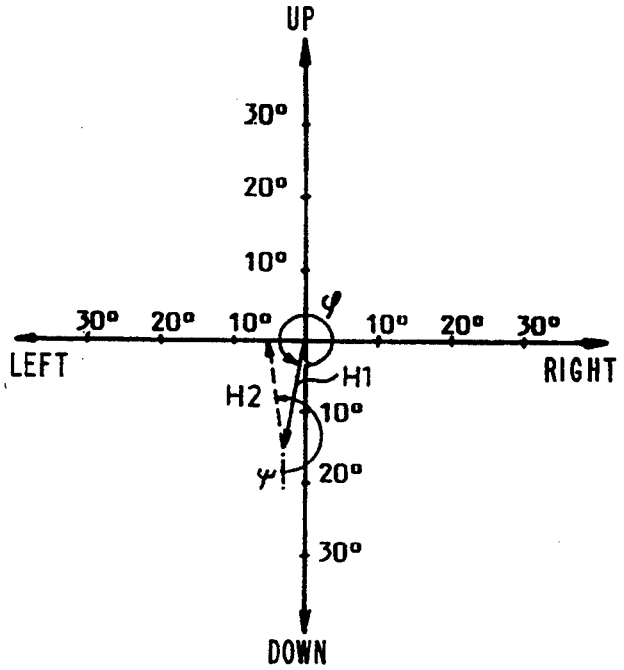
FIG. 9 illustrates an angular setting position of 5° to the left, again without any stern lift.
Figure 10:
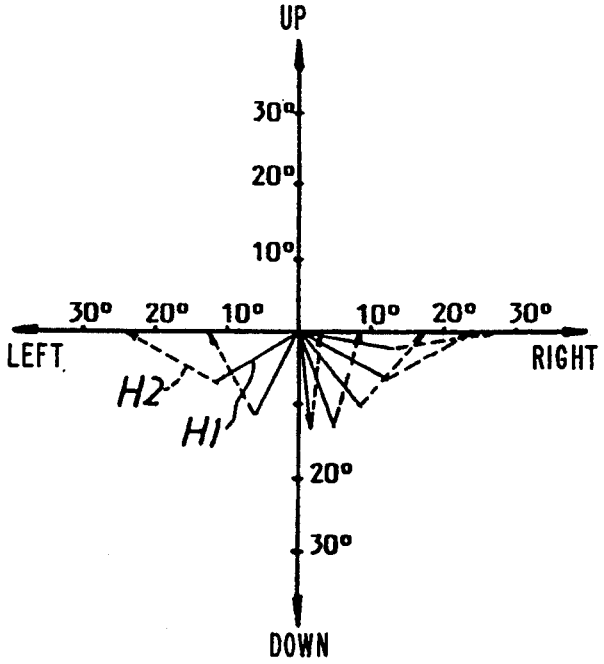
FIG. 10 illustrates that the apex of the arrow for H2 conveniently may be slid along the altitude axis=0.
Figure 11:
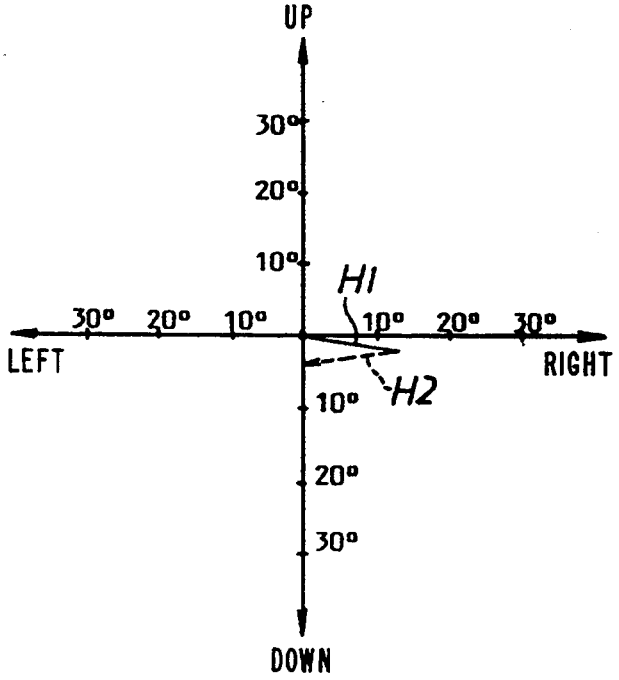

Oppositely, if one wishes only to lift the stern (i.e. without simultaneous yawing), this is quite possible, as illustrated in FIG. 11.

Figure 12:
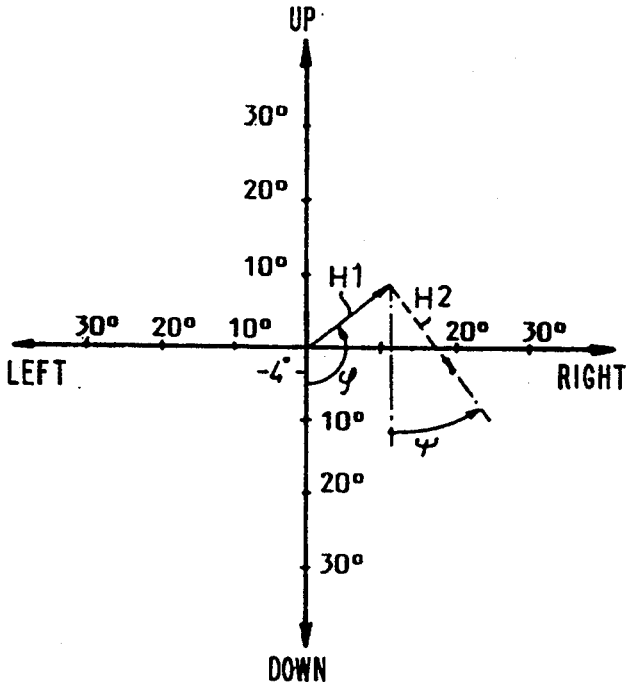

Obviously, it is also necessary to be able to steer the boat during trimming conditions, as shown in FIG. 11. In this case, a vector diagram may be of the kind shown in FIG. 12, representing, as an example, a right-hand yawing motion of 20°.

Figure 13:
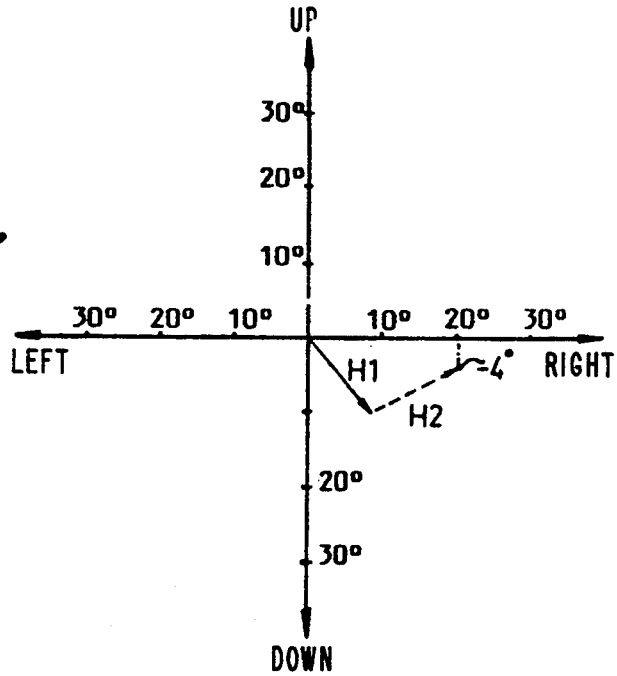

In this connection it is worth mentioning that every desired position of stering and altitude setting may be achieved in two ways. The position in accordance with FIG. 12 could, for instance, be achieved also with different relative setting positions of sleeves 2 and 8, as illustrated in FIG. 13.

Figure 14:
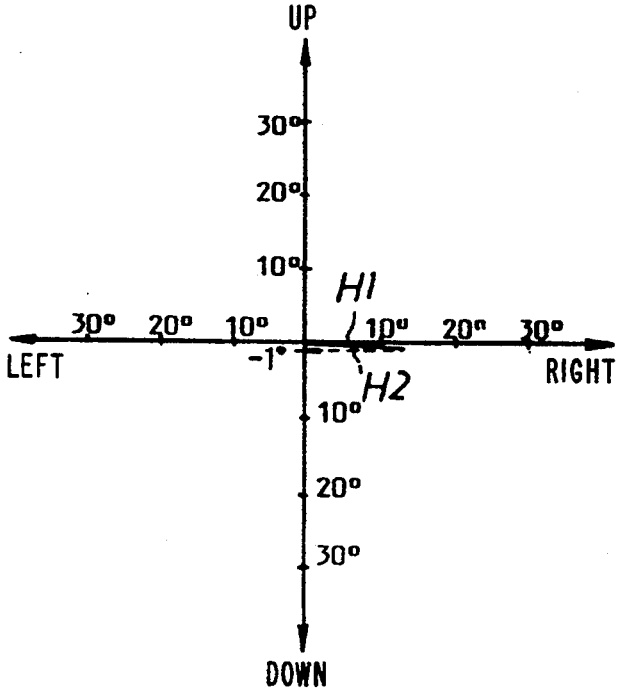
Figure 15:
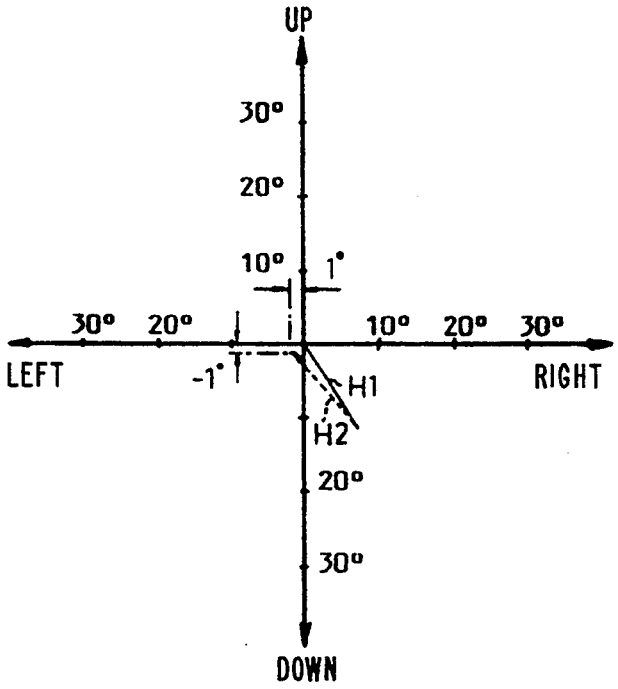
Figure 16:
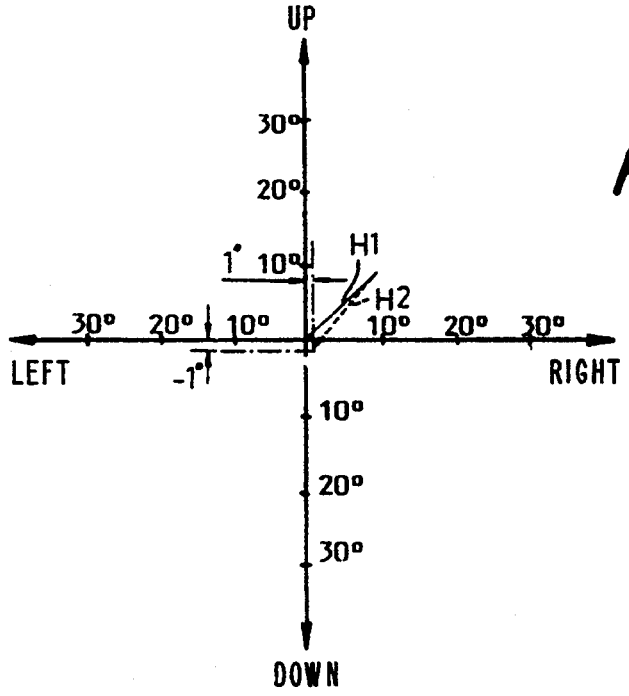

If an insignificant trimming angle (stern lift) is desired, say of the magnitude of one degree only, practical problems do, however, arise. In the case of simultaneous steering by means of small lateral movements oscillating above the position "straight ahead", the deflection angles $\phi$ and $\Psi$ will be large and "fluctuate", see FIGS. 14, 15 and 16.

Figure 17:
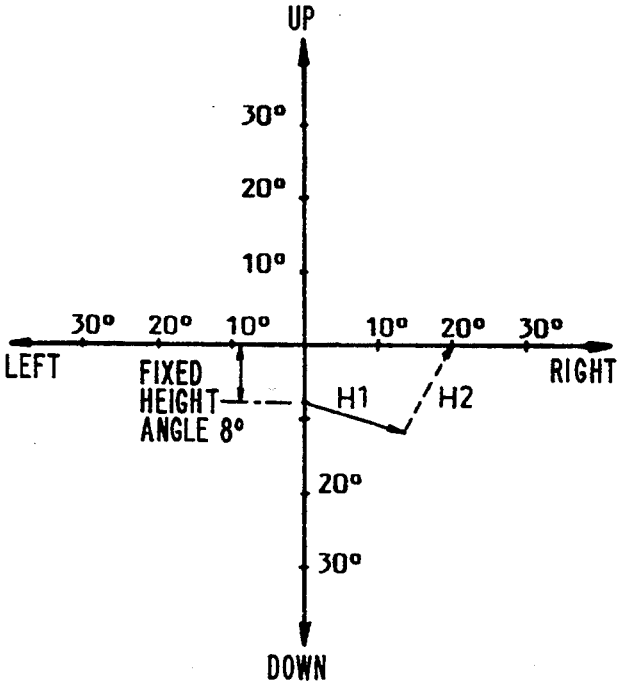

One solution to this problem is to incline the entire device at a "fitting" fixed angle relative to the bottom plane of the boat. Besides, such an angle of inclination is commonly used when the motor shaft extends outwards through the bottom hull of the boat. In the vector diagrams shown herein the centre of rotation concerning H1 must in this case be shifted from origo to a position below origo corresponding to this angle, for instance 8° downwards, as illustrated in FIG. 17. The vectors H1 and H2 are still assumed to be of the same length, for instance 15°. Vector H2 is placed in FIG. 17 in a position corresponding to a 20° yawing movement to the right and without aft lift. With a device set as indicated, the oscillating movements of sleeves 2 and 8 and the angular accelerations associated therewith will be moderate.

Figure 18:
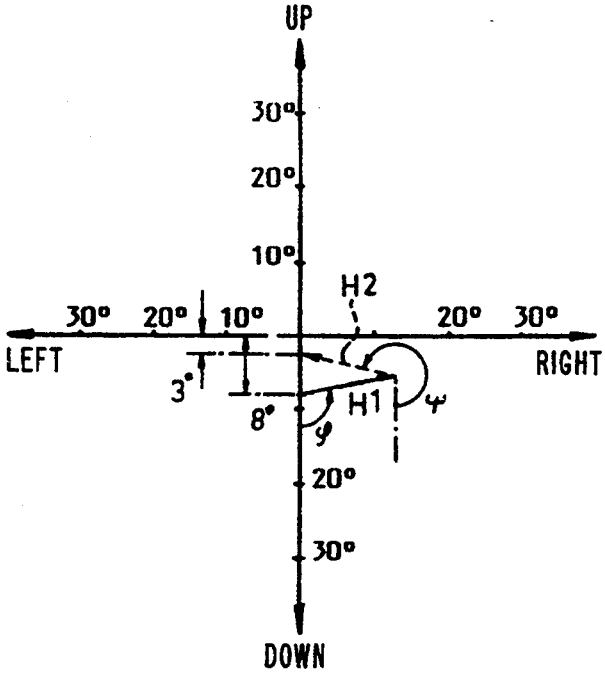

FIG. 18 illustrates a different variety of the fixed-angle setting position of 8°. The steering position is in this case "straight ahead" and the altitude trimming approximately equal to 3°.

Figure 19:
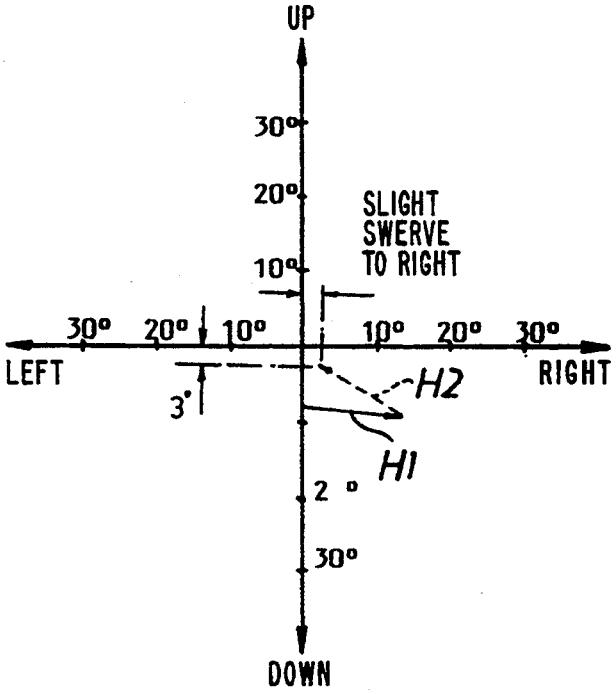

In FIG. 19, finally, is shown a variety of the setting position of FIG. 18. In addition to altitude trim, it shows a slight right-hand yawing situation. This steering mode is a great deal "steadier" than those in accordance with FIGS. 14, 15 and 16, to which reference is made for comparison.

Figure 20:
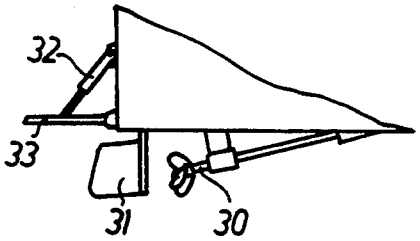

The rest of the drawing figures illustrate a number of practical embodiments to illustrate the much more simple construction that is made possible owing to the device in accordance with the invention compared with the prior-art technology. FIG. 20 shows a conventional construction having a fixed propeller shaft 30, a rudder 31 and one or several trim tabs 33 the position of which may be set with the aid of piston-and-cylinder units 32.

Figure 21:
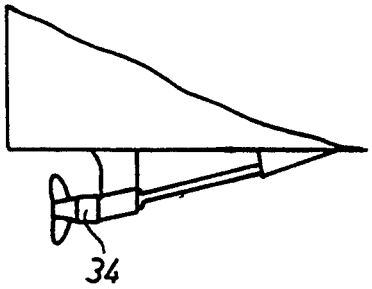

FIG. 21 illustrates, for reason of comparison, a device 34 replacing all setting mechanism according to FIG. 20.

Figure 22:
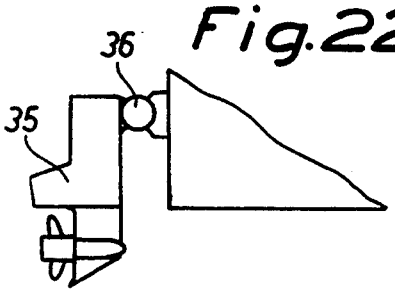

FIG. 22 shows an outboard motor 35 which in the conventional manner is suspended from a boat by means of a joint 36.

Figure 23:
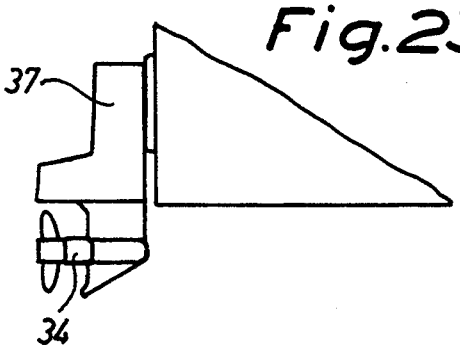

FIG. 23 illustrates the manner in which a corresponding outboard motor may be fixedly secured to the boat whereas the device 34 attends to the steering.

Figure 24:
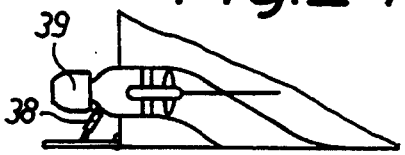

FIG. 24 shows a watercraft which is driven by a water jet. A separate mechanism 38 is required for adjustment of the water jet nozzle 39.

Figure 25:
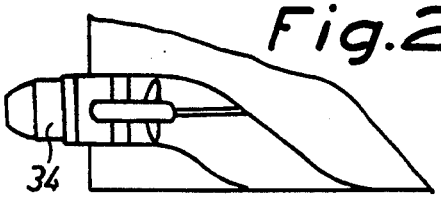

FIG. 25 shows how the device 34 in accordance with the invention may be utilized also for this application.

Figure 26:
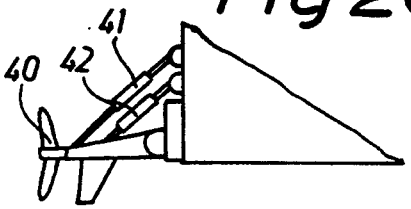

FIG. 26 shows a watercraft having a surface-piercing propeller 40 and corresponding adjustment mechanisms 41 and 42.

Figure 27:
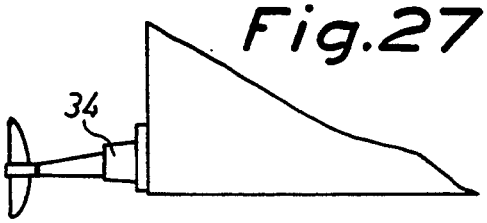

FIG. 27 illustrates how also in this case the device 34 in accordance with the invention may be used.

The invention is not limited to the embodiments as described and illustrated but may be varied in a variety of ways within the scope of the appended claims. This is true for instance as concerns the various mechanisms employed to rotate the sleeves 2 and 12. For instance, the sleeve 2 could project somewhat into the interior of the boat hull past the shell sleeve 1. In the same manner shell sleeve 12 could project into the boat hull past the sleeve 2. To the inner end portions of sleves 2 and 12 could then be connected some type of external setting mechanism, for instance a turnable lever which is fixedly secured to the respective sleeves 2 and 12, a pin-engaging chain travelling about said portions of the respective sleeve 2 and 12 or a pinion in engagement with a row of teeth extending around the jacket face of the respective sleeve 2 and 12.

I claim:

1. A device for setting propulsion means of a watercraft in an arbitrary angular position within a perimeter of an imaginary cone having an apex, the propulsion means having a shaft extending through the apex of the cone, the device comprising:

a first sleeve rotatably disposed about a first axis intersecting the apex of the cone, the first sleeve having a portion extending at an angle relative to the first sleeve; and a second sleeve rotatably disposed about a second axis intersecting the apex of the cone, relative to the portion of the first sleeve, the shaft of the propulsion means extending through the second sleeve from the apex of the cone and out of the second sleeve in a direction at an angle relative to the second axis.

2. A device as claimed in claim 1, wherein the first sleeve comprises a row of teeth extending in a transverse direction of the first sleeve, the device further comprising a rotatable pinion engageable with the row of teeth to rotate the first sleeve in either direction about the first axis.

3. A device as claimed in claim 2, wherein the row of teeth is formed on an interior face of the first sleeve, the device further comprising means for rotating the pinion, the means for rotating the pinion extending in parallel with the first axis.

4. A device as claimed in claim 1, wherein the row of teeth is formed on an external surface of the first sleeve, the device further comprising a screw worm rotatable about an axis transverse to the first axis, the screw worm engageable with the row of teeth.

5. A device as claimed in claim 1, the second sleeve having a first gear rim, the device further comprising a third sleeve rotatably disposed about the first axis, the third sleeve coaxially disposed relative to the first sleeve, the third sleeve having a second gear rim partially engageable with the first gear rim of the second sleeve to rotate the second sleeve in the same direction as the third sleeve, thus moving the shaft so that it describes a conical body of revolution.

6. A device as claimed in claim 1, further comprising a universal joint shaft disposed between an output shaft and the shaft of the propulsion means, the universal joint shaft being at an angle relative to the output shaft as well as to the shaft of the propulsion means.

7. A device as claimed in claim 1, wherein the first sleeve extends through a hull of the watercraft past a shell sleeve, the first sleeve having an inner end portion provided with an external rotating mechanism, such as a lever fixedly attached to the first sleeve, a pin-engaging chain travelling about the first sleeve inner end portion or a pinion engaging in a row of teeth extending around a jacket face of the first sleeve.

* * * * *